US005129548A

United States Patent [19]

Wisniewski

[11] Patent Number: 5,129,548

[45] Date of Patent: Jul. 14, 1992

[54] METHOD AND APPARATUS FOR PROGRAMMABLE BEVERAGE DISPENSING

[75] Inventor: Henry B. Wisniewski, Stretton-on-Fosse Nr Moreton in Marsh, England

[73] Assignee: IMI Cornelius Inc., Anoka, Minn.

[21] Appl. No.: 592,409

[22] Filed: Oct. 3, 1990

[51] Int. Cl.[5] ..... B67D 5/30

[52] U.S. Cl. ..... 222/16; 222/1; 222/641; 141/83; 141/94; 141/DIG. 1

[58] Field of Search ..... 222/1, 14–16, 222/129.1–129.4, 639–641, 644; 364/479, 709.1; 141/83, 94, 95, 102, DIG. 1

[56] References Cited

U.S. PATENT DOCUMENTS

| | | | |
|---|---|---|---|
| 4,006,840 | 2/1977 | Shannon | 222/641 |
| 4,111,243 | 9/1978 | Fetterman | 222/641 |
| 4,890,774 | 1/1990 | Poore | 222/640 |
| 4,967,932 | 11/1990 | Wiley et al. | 222/146.6 |

*Primary Examiner*—Donald T. Hajec
*Assistant Examiner*—Philippe Derakshani
*Attorney, Agent, or Firm*—Sten Erik Hakanson

[57] ABSTRACT

A method and apparatus for dispensing beverage with programmable electronic portion control of one or more serving sizes has the steps of and apparatus for placing a discrete magnet adjacent the electronic control, the control having a reed switch which changes state under influence of the field of the magnet and switches the control from a normal select and dispense mode to an alternative hold and program mode.

12 Claims, 3 Drawing Sheets

METHOD AND APPARATUS FOR PROGRAMMABLE BEVERAGE DISPENSING

BACKGROUND OF THE INVENTION

1. Field of the Invention

This invention pertains to a method and apparatus for non-intrusive setting or programming of an automatic beverage dispenser control.

2. The Prior Art

Beverage control valves for use particularly in dispensing carbonated soft drinks such as a cola, lemonade, etc., essentially mix a concentrate with a carbonated water diluent to form the drink in situ. Such valves are part of the so-called post-mix dispense system. Post-mix dispense systems are used where considerable quantities of beverages are provided, such as in fast food chains, cafes, theatres, licensed outlets, etc.

The alternative type of system is a pre-mix in which the carbonated drink is supplied ready-made to the valve and the valve dispenses quantities of pre-mix drink into a suitable receptacle.

In one type of valve, the valve is controlled by a handle or lever which can be held open and the valve will continue to dispense beverage for as long as the valve is held open. In a second type of valve, the lever is used as part of a sensing circuit to detect the filling of the container into which the beverage is poured and the valve is automatically switched off when the container is full.

In a third type of valve, a fixed portion or quantity of beverage is dispensed into a container. Normally these valves incorporate timer mechanisms and the valve is held open for a fixed period of time to dispense a fixed quantity of beverage.

One preferred type of automatic portion control valve permits the selection of at least one, and preferably three or more adjustable quantities of beverage to produce one, three, or more different portion sizes, a small, a medium, and a large portion, typically 200 cc, 350 cc, or 500 cc of beverage.

The present invention is concerned with the control of the portion sizes for the third type of portion control valve.

It is known to produce a valve in which the portion sizes may be set by an engineer. Essentially, the valve incorporates a switch pad having buttons to determine the size of beverage portion. Effectively, the buttons control the period of time during which the valve is held open and hence the portion size. The electrical circuitry incorporated into the valve detects which switch has been operated and then holds open the valve for a corresponding given period of time. The period of time is adjustable and the adjustment is normally made by putting the valve into a set or programming mode. In the set or programming mode the electrical circuitry is able to detect which switch pad has been operated (i.e., for the small, medium, or large portion) and the length of time operated to control the memory of the device to store the time period for which the valve should be open. The electrical circuitry is then switched from the set mode to the normal use and dispense select mode and the valve can be operated.

Although such systems work well, there is a problem at the present in that to permit the electrical circuitry to be placed in the set or programming mode, it is necessary to remove the valve cover to expose a slide switch on top of the control which enables it to be moved to the set position for setting purposes. Both removal and refitting of the cover can be awkward and, if care is not taken, the wiring of the valve and/or the setting of the regulators can be disturbed. This is particularly the case if the valve is adjusted by an unskilled operator rather than a service engineer. It is, however, desirable that the switch controlling the electrical circuitry permitting access to the setting mode should not be immediately available to the general public lest the setting of the valve be disturbed.

A "secret handshake" or sequential code system of multi-function use of existing external switches also poses problems. The slide switch has also been a problem by itself because it has not been waterproof and syrup deposits on the slide switch adversely influence its operability.

OBJECT OF THE INVENTION

It is an object of the present invention to provide a new and improved method and apparatus for setting or programming an automatic liquid dispenser.

It is an object of the present invention to provide a new and improved method and apparatus for dispensing beverage with a programmable control.

It is an object of the present invention to provide a new and improved method and apparatus for programmable control of beverage dispensing.

SUMMARY OF THE INVENTION

A method of dispensing beverage has the steps of electrically operating a beverage valve, controlling the operation with an electronic control, placing a discrete magnet in proximity to the control and switching the control into a programming mode with the magnet and programming the control while magnetically switched.

A method of programming an electronic beverage dispensing control has the steps of placing a discrete magnet adjacent the control and switching the control into a programming mode with the field of the magnet.

A beverage dispenser has a beverage conduit, an electric dispensing valve, a programmable control, and a magnetically responsive mode changing switch.

An electronic beverage dispenser portion control has valve actuating means, at least one portion size selector switch, dispensing timing means, and a magnetically responsive means for switching the control into a programming mode.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE DRAWINGS

Further understanding of the structure, operation, objects and advantages of the present invention can be had by referring to the following Detailed Description of the Preferred Embodiment, which refers to the following figures, wherein.

DESCRIPTION OF THE PREFERRED EMBODIMENT

Figure 1:
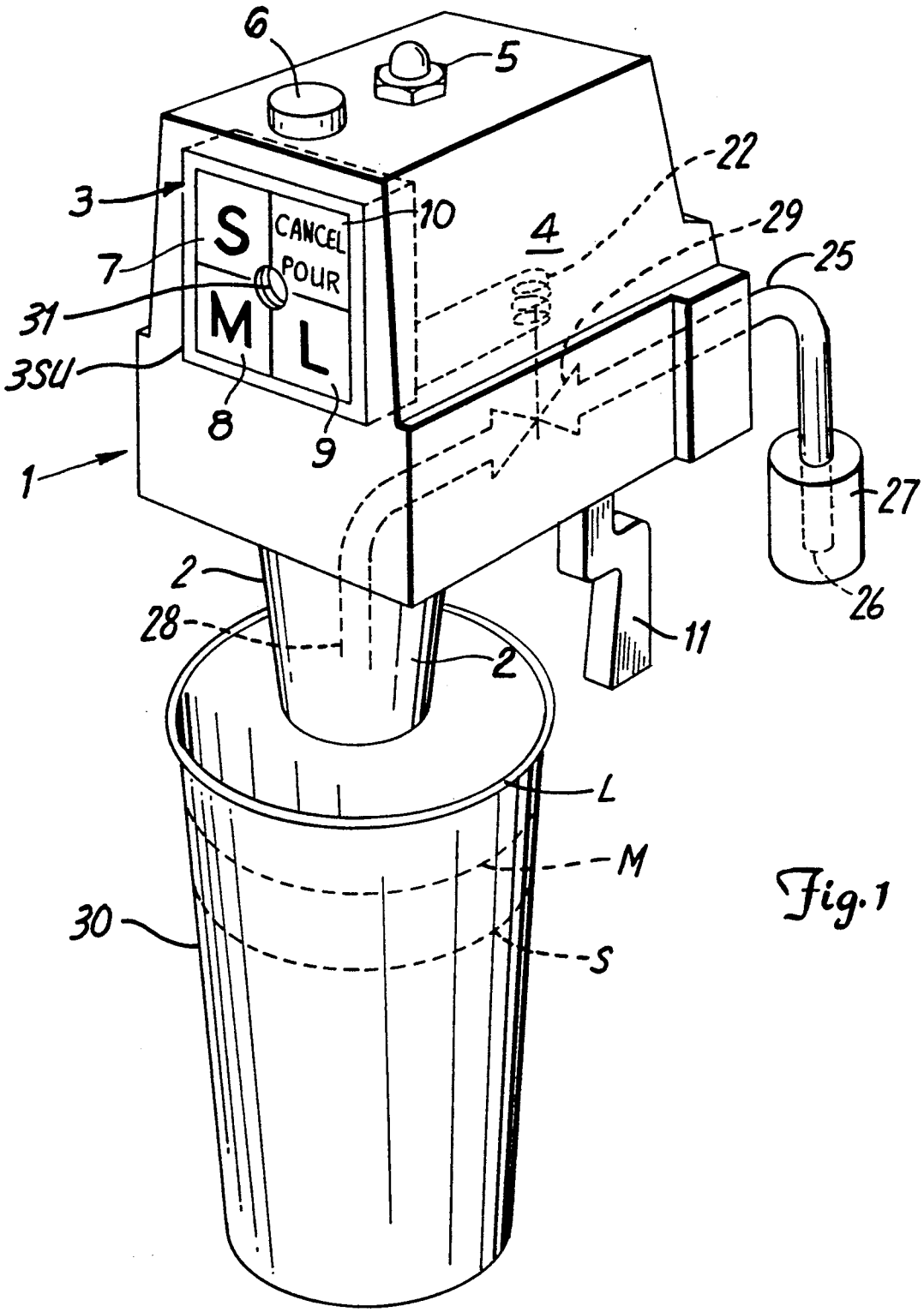
FIG. 1 shows a perspective view of a beverage dispensing valve of the present invention.

Referring to the accompanying drawings, an automatic portion control dispensing head is shown in FIG. 1 and generally indicated by the numeral 1. Head 1 has a dispensing nozzle 2, an electronic portion control housing 3 having a selector switch unit 3SU, and includes a housing cover 4 held on by a fastener nut 5.

An important feature of this invention is the provision and use of a discrete loose magnet 6 that is shown sitting on top of cover 4 and in close proximity to control 3, for reasons which will subsequently be explained.

Figure 2:
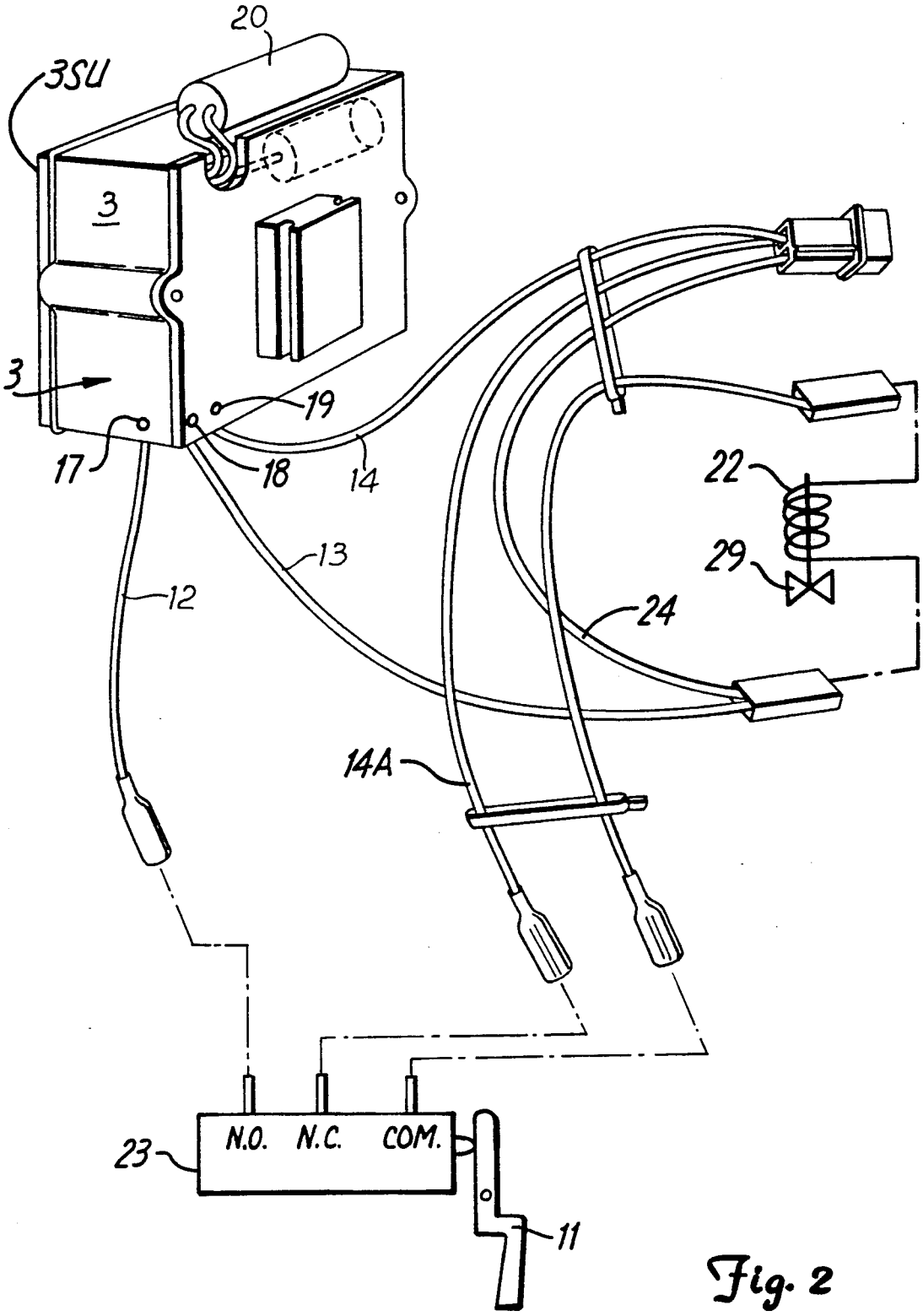
FIG. 2 shows the reed switch and control housing of the present invention and the electrical connecting thereof with a mechanical actuator dispensing switch.

The selector switch unit 3SU preferably has three separate switches 7, 8, and 9 for small, medium, and large size portions respectively. Switch unit 3SU, for purposes of this invention, can have one or more switches. Switch unit 3SU also has a discrete cancel/-pour switch 10. Head 1 also preferably has a relatively short depending actuator lever 11. As shown in FIG. 2 control housing 3 comprises a hermetically sealed box from which extends leads 12, 13, and 14.

Figure 3:
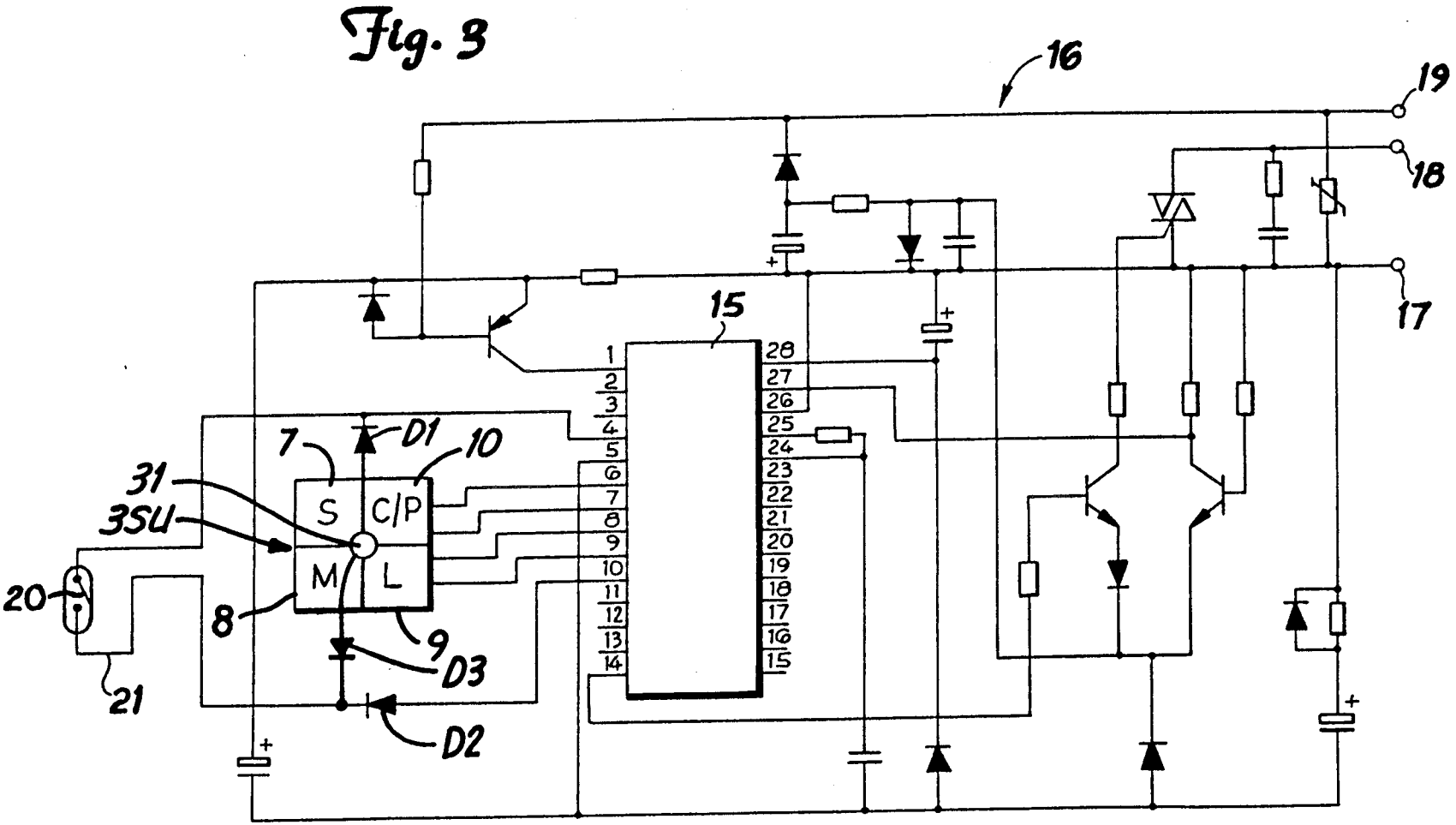
FIG. 3 shows a schematic diagram of the electronic control of the present invention.

A control circuit is held within housing 3 and is generally indicated by the numeral 16, the schematic of which is shown in FIG. 3. Control 16 includes a microprocessor-based controller chip 15 which is operatively connected to the switches 7, 8, 9, and 10, and in the present invention a Motorola Model EL1600 IC chip is used. Power to control circuit 16 is provided at terminals 17 and 19 which are converted to leads 12 and 14 respectively. Terminal 18 supplies power via lead 13 to one or more beverage dispense solenoids 22.

A conventional mechanical dispensing actuator switch 23 is installed in the wiring with lead 12 being connected to an NC terminal, lead 14*a* being connected to an NO terminal and solenoid lead 24 being connected to a C terminal of the actuator switch 23. Actuator switch 23 is operatively connected to actuator lever 11.

Referring back to FIG. 1, a beverage conduit 25 extends through head 1 and has an inlet 26 connectible to a source of beverage 27 and an outlet 28 of nozzle 2. A normally closed (NC) dispensing valve 29 is disposed in the conduit 25 upstream of nozzle 2 and is operatively connected to solenoid 22. Head 1 provides for the filling of different sizes of cups 30 using manual start and programmed automatic shut-off of dispensing.

To operate head 1, a beverage receptacle, such a cup 30, is placed under nozzle 2 and the appropriate switch 7, 8, or 9 is operated to cause dispensing of a small, medium or large portion respectively, following by automatic shut-off as controlled by control circuit 16. If top-off of the receptacle 30 to complete filling is desired, the operator can operate pour switch 10 or lift up and push the receptacle 30 against short lever 11 to complete such filling.

An important feature of this invention is the provision and use of a magnetically controllable reed switch 20 for switching circuit 16 between a mode setting or programming setting. In FIG. 2, reed switch 20 is shown mounted on the top of the control housing 3. Alternatively and preferably, reed switch 20, seen in phantom outline in FIG. 2, is mounted inside of housing 3 and is positioned adjacent to a top surface 3A thereof. In this embodiment reed switch 20 is preferably hermetically sealed within housing 3.

Reed switch 20 is normally open (NO) and in both embodiments is positioned closely adjacent to cover 4 so that when magnet 6 is placed against cover 4, reed switch 20 will close and control circuit 16 will go into an alternative setting or programming mode. A mode circuit portion 21 of control circuit 16 includes a common line 25 shared by switch unit 3SU and connected in parallel by diode D1 to switch unit 3SU. A signal supply line 26 extends to reed switch 20 and has a diode D2. Control circuit 16 also preferably has a mode indicator 31 which is preferably an LED having a diode D3 connected therewith. When reed switch 20 is closed, indicator 31 becomes illuminated to indicate control circuit 16 is in the alternative programming mode.

Reed switch 20 is preferably located just under and adjacent to a generally horizontal top surface 4A of cover 4, enabling magnet 6 to be placed and set on top of cover 4 and over reed switch 20. Magnet 6 will then remain in place on cover 4 without the necessity of being manually held.

With magnet 6 in place, the magnetic field thereof causes reed switch 20 to close and switch control circuit 16 into the alternative programming mode. A small receptacle 30 is placed under nozzle 2 and switch 7 is held depressed for the time it takes the small receptacle 30 to be filled. A medium receptacle 30 is then placed under nozzle 2 and switch 8 is held depressed for the time it takes to fill the medium receptacle 30. A large receptacle 30 is then placed under nozzle 2 and switch 9 is held depressed for the time it takes to fill the large receptacle 30. The control circuit 16 is now completely programmed and magnet 6 is removed whereupon reed switch 20 opens, indicator 31 goes off and control circuit 16 is returned to the normal dispensing mode.

Subsequent depression of any portion size selector switch 7, 8, or 9 enables control circuit 16 to activate solenoid 22 and valve 29 to cause pouring for the programmed time period to properly fill the particular size of receptacle 30 to which control circuit 16 was programmed during the programming mode.

This method and apparatus are non-intrusive and do not require the removal of cover 4. The componentry cost is low and reliability and adaptability are very high. The entire control circuit 16 is hermetically sealed and invulnerable to condensate, beverage syrups, and ingredients.

Although other advantages may be found and realized, and various modifications may be suggested by those versed and experienced in the art, it will be understood that I wish to embody within the scope of the patent warranted hereon, all such embodiments as reasonably and properly come within the scope of my contribution to the art.

I claim:

1. A programmable portion controlled liquid dispensing valve, comprising:

at least one selection switch for selecting the dispensing of a programmed liquid volume, control means for controlling the dispensing of the programmed volume in response to the operating of the selection switch, the control means having a dispensing mode for dispensing the programmed liquid volume and a programming magnetically operable mode for permitting the changing of the programmed liquid volume to a different liquid volume value, and mode switch means for switching the control means between the dispensing mode and the programming mode, the mode switch means responsive to a magnetic field so that the mode switch means is operable without requiring any direct physical contact therewith.

2. The valve as defined in claim 1, and the mode switch means comprising a magnetically operable reed switch.

3. The valve as defined in claim 1, and the valve having an outer housing and the mode switch means located within the housing and the housing being formed at least in part of a magnetically transparent material to permit operating of the mode switch means by the magnetic field.

4. The valve as defined in claim 1, and the valve further including a permanent magnet for providing the magnetic field for operating the mode switch means.

5. The valve as defined in claim 1, and including a plurality of selection switches each providing for the dispensing of a particular programmed liquid volume, and each particular programmed liquid volume separately programmable to a different liquid volume value.

6. A programmable portion controlled liquid dispensing valve, comprising:

at least one selection switch for selecting the dispensing of a programmed liquid volume, control means for controlling the dispensing of the programmed volume in response to the operating of the selection switch, the control means having a dispensing mode for dispensing the programmed liquid volume and a programming mode for permitting the changing of the programmed liquid volume to a different liquid volume value, and magnetically operable mode switch means for switching the control means between the dispensing mode and the programming mode, the mode switch means responsive to a magnetic field so that the mode switch means is operable without requiring any direct physical contact therewith, and the valve having an outer housing and the mode switch means located within the housing and the housing being formed at least in part of a magnetically transparent material to permit operating of the mode switch means by the magnetic field.

7. The valve as defined in claim 6, and the mode switch means comprising a magnetically operable reed switch.

8. The valve as defined in claim 6, and the valve further including a permanent magnet for providing the magnetic field for operating the mode switch means.

9. The valve as defined in claim 6, and including a plurality of selection switches each providing for the dispensing of a particular programmed liquid volume, and each particular programmed liquid volume separately programmable to a different liquid volume value.

10. A method of programming a programmable portion controlled liquid dispensing valve, the valve having at least one selection switch for selecting the dispensing of a programmed liquid volume, and having control means for controlling the dispensing of the programmed volume in response to the operating of the at least one selection switch, the control means having a dispensing mode for dispensing the programmed liquid volume and a programming mode for permitting the changing of the programmed liquid volume to a different liquid volume value, and the valve further including mode switch means for switching the control means between the dispensing mode and the programming mode, the mode switch means responsive to a magnetic field so that the mode switch means is operable without requiring direct physical contact therewith, the method comprising the steps of: providing a magnetic field of sufficient strength in the vicinity of the mode switch means for operating thereof for placing the control means in the programming mode, operating the at least one selection switch for a desired length of time for creating a new programmed dispensing volume, and magnetically affecting the mode switch means for returning the control means to the dispensing mode.

11. The method as defined in claim 10, and the step of magnetically affecting the mode switch means comprising removing the magnetic field from the vicinity of the mode switch means for returning the control means to the dispensing mode.

12. The method as defined in claim 10, and the mode switch means comprising a magnetically operable reed switch.

* * * * *